United States Patent [19]

Bruce-Sanders

[11] 4,429,478

[45] Feb. 7, 1984

[54] VARIABLE INFORMATION SIGN

[76] Inventor: James Bruce-Sanders, 4184 Rose Crescent, West Vancouver, B.C., Canada, V7V 2N8

[21] Appl. No.: 277,707

[22] Filed: Jun. 26, 1981

[51] Int. Cl.[3] ..... G09F 19/06

[52] U.S. Cl. ..... 40/447; 40/463; 40/472; 40/467

[58] Field of Search ..... 40/447, 450, 452, 463, 40/466, 467, 468, 469, 470, 471, 472, 478; 346/21, 29, 140 R; 400/121, 125; 340/788; 178/30; 101/93.04, 103; 401/220

[56] References Cited

U.S. PATENT DOCUMENTS

| | | | |
|---|---|---|---|
| 2,719,314 | 10/1955 | Taube | 401/220 |
| 3,434,153 | 3/1969 | Sonntag | 346/21 |
| 3,562,758 | 2/1971 | Ringrose | 346/21 |
| 3,604,326 | 9/1971 | James et al. | 346/21 |
| 3,707,002 | 12/1972 | Howell | 346/141 |
| 3,729,731 | 4/1973 | Konnerth et al. | 346/21 |
| 3,909,593 | 9/1975 | Olson | 346/141 |
| 3,945,022 | 3/1976 | Distler | 346/75 |
| 3,949,132 | 4/1976 | Seregely et al. | 428/207 |
| 3,949,392 | 4/1976 | Caritato | 340/336 |
| 3,968,498 | 7/1976 | Uchiyama | 346/29 |
| 4,002,230 | 1/1977 | Schweppe et al. | 197/1 |
| 4,122,459 | 10/1978 | Schloemann et al. | 346/140 |
| 4,152,984 | 5/1979 | Utzinger | 101/103 |
| 4,208,139 | 6/1980 | Fujimoto et al. | 400/126 |

*Primary Examiner*—Gene Mancene
*Assistant Examiner*—David L. Tarnoff
*Attorney, Agent, or Firm*—Christensen, O'Connor, Johnson & Kindness

[57] ABSTRACT

The variable information sign includes, in one embodiment, a display board 10 having a smooth and nonporous display surface 10A, a carriage 12 supported from and movable with respect to display board 10, a plurality of print modules 14 that are supported by carriage 12, an erase roller 16 also supported from carriage 12, and a re-inking station 18 supported from display board 10 and located at one side thereof. Each of the print modules contains a supply of a dry erase ink which is located into the print module when the carriage is in proximity to the re-inking station. As the carriage is caused to move in a predetermined direction, each of the print modules is deactuated and the erase roller wipes the display surface to remove any previously-printed information. As the carriage is caused to move in a second or opposite direction, the erase roller wipes the display surface to remove any remaining portion of the previously-printed information and the print modules are selectively actuated to print desired information on the display surface. In a second embodiment, the display member comprises an endless belt of a suitable flexible material which passes around first and second drums supported for rotation about parallel axes. The print modules are disposed in proximity to one of the drums the erase roller is disposed in proximity to the other of the drums. As the drums are rotated, the flexible belt passes the erase roller and the print module whereupon information is removed from the belt by the erase roller and information is imprinted on the belt by the print modules.

28 Claims, 9 Drawing Figures

VARIABLE INFORMATION SIGN

FIELD OF THE INVENTION

This invention generally relates to display apparatus and more particularly to a billboard-type sign for displaying variable information.

BACKGROUND OF THE INVENTION

Electrical and mechanical billboard-type signs have come into widespread use in sporting arenas, on buildings, and in other applications in which it is desired to provide a relatively large display of variable information. The great majority of such signs include a display surface having a background portion in which is located a plurality of incremental display positions or "pixel" locations. By selectively controlling the contrast of the pixel locations with respect to the background portion of the display surface, variable information such as alphanumeric characters, messages formed from such characters, and graphics can be displayed.

An electrical billboard-type sign in common use includes a plurality of incandescent lamps at the pixel locations that are selectively energized in accordance with the information to be displayed. In order to provide sufficient contrast and therefore display visibility under high ambient light conditions, each incandescent lamp typically has a wattage in the range of 60–100 watts. Although the number of incandescent lamps used in such an electrical sign varies with the size of the sign and the desired resolution of the display, it is apparent that such a sign has a relatively high energy consumption. For example, one such sign used for the Montreal Olympics has 76,800 incandescent lamps with a resultant nominal energy consumption in the megawatt range. The incandescent lamps are also subject to frequent failure, thereby necessitating frequent and expensive maintenance, and the selective energization of the lamps is controlled by very complex and therefore very expensive circuitry.

In another type of electrical billboard-type sign, the display surface is formed by a screen having a plurality of apertures at the pixel locations. Behind the screen are located a plurality of continuously energized fluorescent lamps. Each aperture in the screen has associated therewith a shutter which can be moved to either cover or uncover the aperture, and a shutter-actuating mechanism is provided which moves behind the screen and which includes a plurality of magnets whose positions can be selectively controlled to selectively move the shutters in accordance with the information to be displayed. Although such an electrical sign can have significantly lower energy consumption and improved display resolution over signs using incandescent lamps, the contrast and therefore display visibility provided by the sign is very low so that the sign can be used only in low ambient light conditions. Further, proper and continued operation of the shutters and the shutter-actuating mechanism requires that very fine mechanical tolerances must be met and maintained.

A mechanical billboard-type sign in common use includes a plurality of multiple-sided display elements, such as blocks or discs, at the pixel locations. Each display element is individually mounted for rotation, and each side thereof has a contrasting surface. An actuating means, typically of mechanical or electromechanical construction, is provided for selectively rotating the display elements in accordance with the information to be displayed. Although the display afforded by such a mechanical sign is visible under most ambient light conditions and although such a mechanical sign generally consumes less electrical energy than the electrical signs previously described, proper and continued operation of the mechanical sign requires that very fine tolerances be met and maintained for the display elements and the actuating means therefor. Because of the mechanical nature of and the fine tolerances required for the display elements and the actuating means, the mechanical sign is very expensive to construct and maintain and the resolution afforded by the display thereof is generally not sufficient to permit the display of graphics.

It is therefore an object of this invention to provide an improved billboard-type sign for displaying variable information.

It is another object of this invention to provide such a sign which consumes a relatively small amount of electrical energy when compared to the electrical energy consumed by previously known and used electrical signs.

It is yet another object of this invention to provide such a sign which includes a minimum number of components and which therefor is relatively inexpensive to construct when compared with previously known and used billboard-type signs.

It is still another object of this invention to provide such a sign which requires very little maintenance over extended periods of time.

It is a further object of this invention to provide such a sign whose display is visible under adverse ambient light conditions.

It is yet a further object of this invention to provide such a sign whose display resolution is sufficient to permit graphics to be displayed.

SUMMARY OF THE INVENTION

Briefly, the foregoing objects and other objects and advantages that will be apparent from the consideration of the entire specification are achieved in a variable information sign that comprises:

- a display member having a smooth and substantially nonporous display surface;
- a plurality of print modules disposed in proximity to the display member so as to face the display surface, with each print module including a pad of porous material containing a dry erase ink and being selectively actuable to bring the pad into contact with the display surfce so as to print an image thereon;
- erase means disposed in proximity to the display member so as to face the display surface, for wiping the display surface to remove any image thereon;
- means for producing relative motion between the display member and the plurality of print modules and between the display member and the erase means, the plurality of print modules and the erase means being arranged so that upon such relative motion, any previously-printed images are first removed from the display surface by the erase means and an image of information desired to be displayed is thereafter formed on the display surface as the plurality of print modules are selectively actuated.

The display member may be stationary and the plurality of print modules and the erase means may be moved relative to the display member, or, the plurality of print modules and the erase means may be stationary and the display member may be moved relative thereto.

In the sitatuion where the display member is stationary, the display member may comprise a porcelain-coated board, and the plurality of print modules and the erase means are mounted on and movble with a carrige that is supported for translative motion relative to the display member. In the situation where the display member is movable, the display member includes first and second, spaced-apart drums supported for rotation about substantially parallel axes, and an endless belt of flexible material (such as polypropylene) that psses around the first and second drums. The plurality of print modules are disposed in proximity to one of these drums and face the portion of the belt that passes around that drum, and the erase means is disposed in proximity to the other drum and faces the portion of the belt that passes around that drum.

Preferably, each print module further includes:

an arm supported for rotation, the pad of the print module being mounted on the arm;

means biasing the arm to a rest position wherein the pad is out of contact with the display surface; and, means responsive to actuation of the print module for rotating the arm away from the rest position to bring the pad into contact with the display surface.

Preferably, the erase means includes a roller of absorbent material that is supported for rotation about an axis that is transverse to the relative motion between the display member and the erase means, with the roller being continuously rotated upon relative motion between the display member and the erase means.

Provision is also made for re-inking of the plurality of print modules.

BRIEF DESCRIPTION OF THE DRAWINGS

The invention can best be understood by reference to the following portion of the specification, taken in conjunction with the accompanying drawings in which.

BRIEF DESCRIPTION OF A PREFERRED EMBODIMENT

Figure 1:
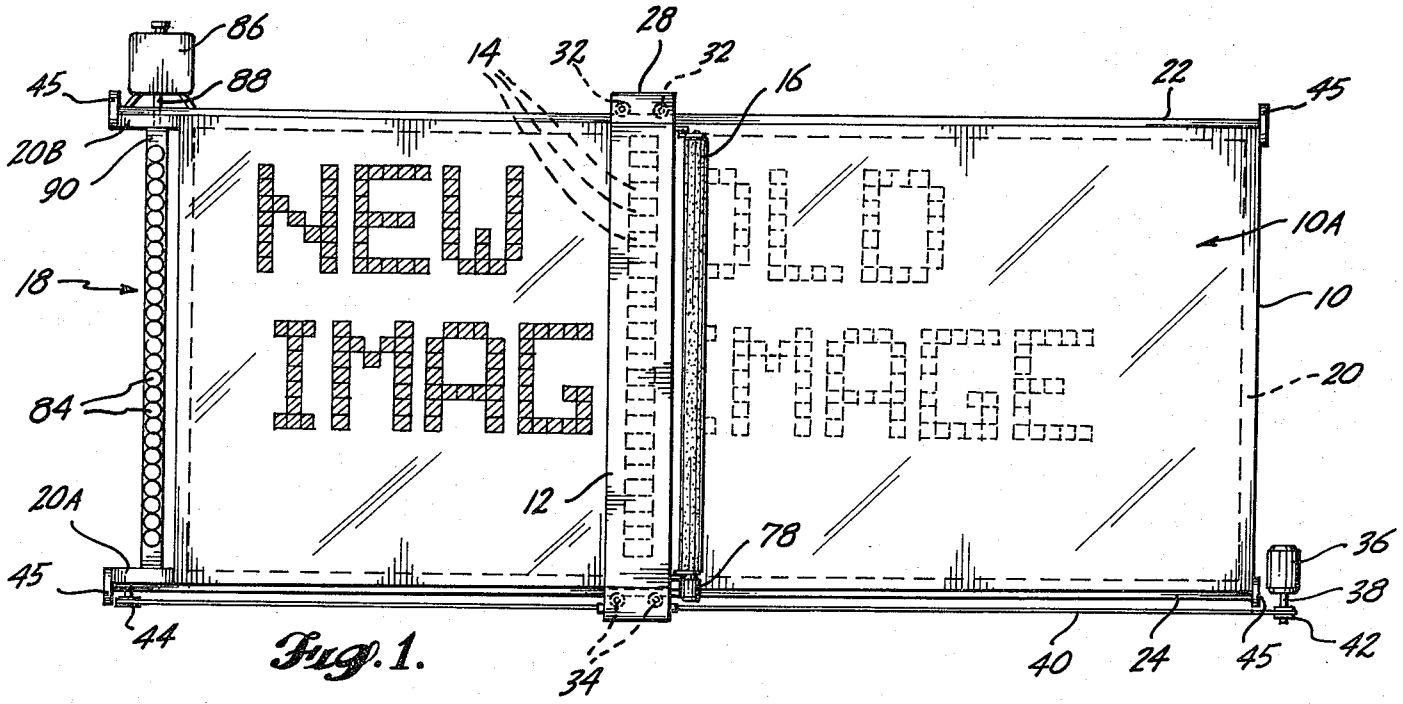
FIG. 1 is a front elevation view of a first embodiment of the variable information sign.
Figure 2:
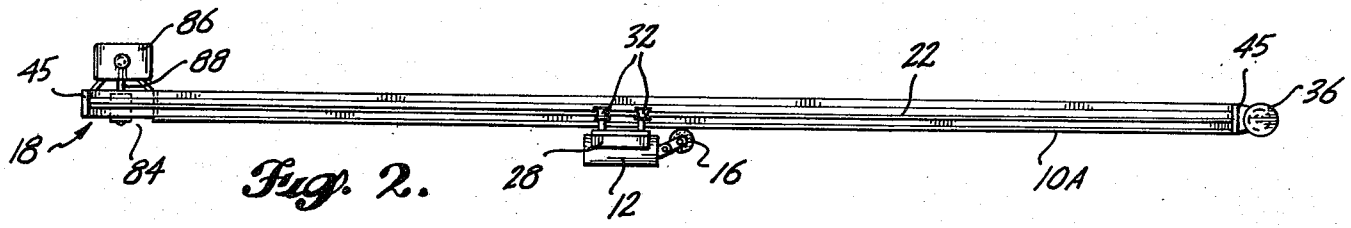
FIG. 2 is a top plan view corresponding to FIG. 1.

Referring now to FIGS. 1 and 2, the major elements of the embodiment of the variable information sign therein are a display board 10, a carriage 12 supported from and movable wit respect to display board 10, a plurality of print modules 14 (shown in dashed-outline in FIG. 1) that are supported by carriage 12, an erase roller 16 also supported from carrige 12, and a re-inking station 18 supported from display board 10 and located at one side thereof.

Display board 10 has a display surface 10A having a uniform light reflectance, and the print modules 14 and erase roller 16 supported by carriage 12 face display surface 10A. Each of the print modules 14 contains a supply of a dry erase ink which is loaded into the print module when carriage 12 is in proximity to re-inking station 18. This dry erase ink is of the type that can be deposited by each of print modules 14 on a smooth and substantially nonporous surface such as display surface 10A to "print" a semipermanent image which can be removed by a wiping action provided by erase roller 16, and contains a dye or dyes having a differing light reflectance than that of display surface 10A. As carriage 12 is caused to move in a predetermined direction (e.g., from the right in FIGS. 1 and 2 to re-inking station 18), each of the print modules 14 is deactuated and erase roller 16 wipes display surface 10A to remove any previously-printed information. As carriage 12 is caused to move over display surface 10A in a second or opposite direction (e.g., from re-inking station 18 to the right in FIGS. 1 and 2), erase roller 16 wipes display surface 10A to remove any remaining portion of the previously-printed information (the "old image") and print modules 14 are selectively actuated to print desired information (the "new image") on display surface 10A.

Figure 3:
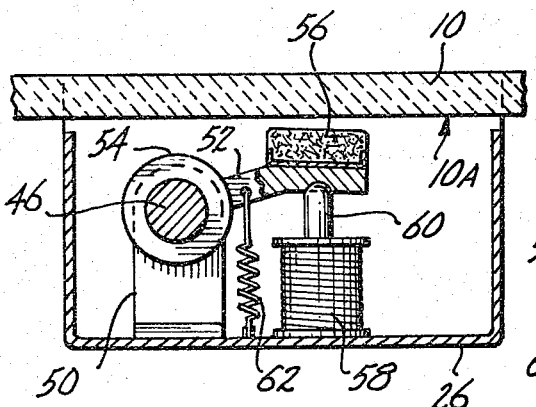
FIG. 3 is a cross-sectional plan view of a carriage in the sign of FIG. 1 when that carrige is in proximity to a display surface of the sign.
Figure 4:
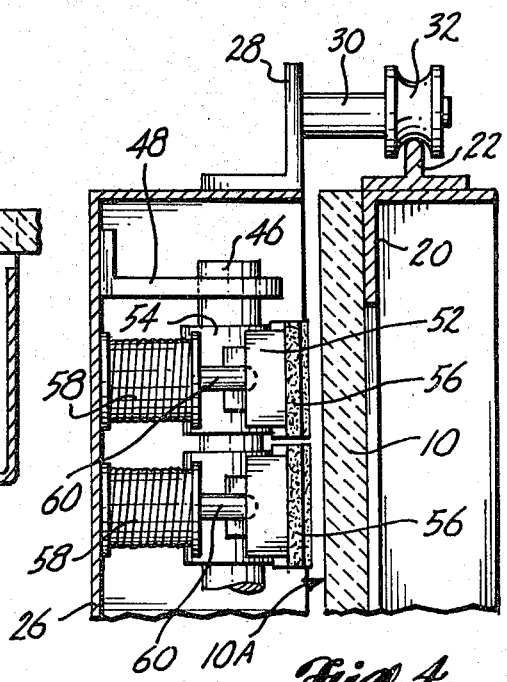
FIG. 4 is a cross-sectional elevational view of the carriage when that carriage is in proximity to the display surface.

With additional reference now to FIGS. 3 and 4, display board 10 is mounted on an angle frame 20 which extends around the periphery of display board 10 and which is secured to the surface of display board 10 opposite display surface 10A. First and second T-bars 22,24 are respectively secured to the upper and lower portions of angle frame 20 and extend along the length of display board 10. Carriage 12 includes a channel frame 26 whose open side faces display surface 10A. An angle 28 is secured to the upper end of channel frame 26 and has extending therefrom a pair of shafts 30 on which are rotatably journaled a pair of grooved rollers 32. Likewise, a similar angle and a pair of shafts extending therefrom (not illustrated) are secured to the lower end of channel frame 26, with these shafts having rotatably journaled thereon a pair of grooved rollers 34. Grooved rollers 32 ride on T-bar 22 and grooved rollers 34 ride on T-bar 24 so as to support carriage 12 from display board 10 for movement relative thereto. The position of carrige 12 with respect to display surface 10A is controlled by a motor 36 supported by angle frame 20 and located at one side of display board 10 (e.g., the side opposite re-inking station 18), with an output shaft 38 of motor 36 being coupled to carriage 12 by a flexible belt or cable 40 whose respective ends are attached to channel frame 26 and which passes around a pulley 42 mounted on shaft 38 and a pulley 44 rotatably mounted on an extended portion 20A of angle frame 20 at a loction proximate to re-inking station 18. A plurality of stops 45 are secured to angle frame 20 and positioned adjacent to the end of display board 10 proximate motor 36 and the end of display board 10 proximate re-inking station 18 so as to be engaged by rollers 32 and 34 to limit the rightward and leftward travel of carriage 12. As described in detail hereinafter with reference to FIG. 7, motor 36 is provided with appropriate driving signals from an electronic control means that preferably includes a programmed data processor and an encoder mounted on shaft 38 that functions to provide signals to the programmed data processor representing the relative position of carriage 12.

Disposed within channel frame 26 of carriage 12 is a shaft 46 which is mounted from channel frame 26 by an upper angle 48 (FIG. 4) and a lower angle 50 (FIG. 3) so that shaft 46 extends transversely to the directions of movement of carrige 12. Each of the print modules 14 is supported on shaft 46, so that print modules 14 are aligned in a direction transverse to the directions of movement of carriage 12. Each print module 14 includes: an arm 52 that is rotatably mounted at an appropriate location on shaft 46 by an associated collar 54; a replaceable pad 56 of porous material secured to arm 52; a solenoid 58 secured to channel frame 26 and having a plunger 60 engaging arm 52; and, a tension spring 62 extending between arm 52 and channel frame 26 and rotatably biasing arm 52 to a rest position whereby pad 56 is out of contact with display surface 10A. Each solenoid 58 is either energized or deenergized by an appropriate electrical signal from the electronic control means, and the electrical signals from the electronic control means are coupled to the corresponding solenoids by a flexible cable (not illustrated) that is looped behind display board 10 and that enters carriage 12 at the top of channel frame 26. When solenoid 58 is deenergized, arm 52 is in its rest position due to tension spring 62. When solenoid 58 is energized, plunger 60 thereof is extended to rotate arm 52 against the force exerted thereon by tension spring 62 so as to bring pad 56 into contact with display surface 10A.

Figure 6:
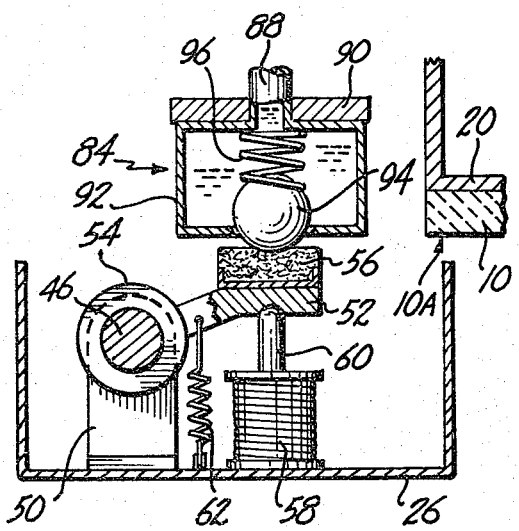
FIG. 6 is a cross-sectional plan view of the carriage when that carriage is in proximity to a re-inking station of the sign.

Pad 56, which preferably is composed of felt, contains the dry erase ink that has been loaded therein at re-inking station 18 as will be described in more detail hereinafter in conjunction with FIG. 6. Dry erase inks suitable for use in the sign are availble from a number of manufacturers, such as Sanford Corporation, of Chicago, Ill., and preferably have the composition and characteristics set forth in U.S. Pat. No. 3,949,132, Seregely et al. The composition of such inks typically includes a solvent (usually water-based), a release agent, a surfactant, a dye or dyes that are insoluble in the release agent, and wax. As the ink is deposited on display surface 10A by pad 56, the surfactant prevents retraction of the ink into small droplets. Upon vaporation of the solvent and "drying" of the ink, the release agent forms a film on display surface 10A and the dye, being insoluble in the release agent, forms a layer on the release agent film. If the dye is chosen to have a differing light reflectance than that of display surface 10A, it can be seen that deposit of the ink will print a semipermanent image on display surface 10A. If the sign is placed in an exterior location and if the dry erase ink includes a water-based solvent, an appropriate transparent screen should be used in conjunction with the sign so as to shield display surface 10A from ambient moisture that would otherwise distort the information being displayed.

The minimum vertical dimension of the image thus printed by each print module (or, the image dimension in a direction transverse to the direction of movement of carriage 12) is determined by the vertical dimension of pad 56, and the minimum horizontal dimension of the image (or, the image dimension in a direction parallel to the direction of movement of carriage 12) is determined by the horizontal dimension of pad 56 and the time during which pad 56 is in contact with display surface 10A as carriage 12 is moved relative thereto. These minimum image dimensions may be chosen to represent a pixel, with the relative vertical locations of the pixels or "rows" of the display being determined by the relative vertical spacing of the print modules and with the relative horizontal locations of the pixels or "columns" of the display being determined by the horizontal locations of carriage 12 at which the print modules are actuated. It can therefore be appreciated that the electronic control means may cause any desired information to be displayed by selectively applying electrical signals to the solenoids 58 within the print modules and driving signals to motor 36 in response to position signals from the encoder on shaft 38 of motor 36 and in accordance with the information to be displayed.

In order to provide a precisely-defined and durble image that yet can be easily erased, display surface 10A must be both nonporous and smooth, e.g., free of any surface imperfections that would retain or disperse the ink applied thereto. Display board 10 preferably comprises a porcelain-coated board although certain plastic material such as polypropylene can be advantageously used (as well be apparent from the discussion in conjunction with FIGS. 8 and 9).

Figure 5:
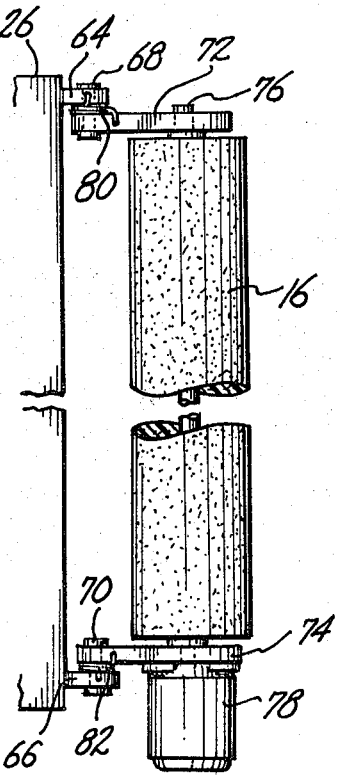
FIG. 5 is an enlarged front elevation view of an erase roller in the sign of FIG. 1.

Once the ink has dried, the semipermanent image can be removed by the wiping action of erase roller 16. With additional reference now to FIG. 5, upper and lower brackets 64,66 are secured to channel frame 26 of carriage 12 and extend therefrom. Brackets 64 and 66 respectively support pins 68 and 70 on which are rotatably journaled respective upper and lower support arms 72,74. A shaft 76 extends between support arms 72 and 74 and is rotatably journaled therein, with erase roller 16 being affixed to and rotatable with shaft 76. A motor 78 is mounted on lower support arm 74 and the shaft of motor 78 is coupled with shaft 76. Coil springs 80 and 82 have their respective ends bearing on upper bracket 64 and upper support arm 72 and lower bracket 66 and lower support arm 74 so as to resiliently bias erase roller 16 into contact with display surface 10A.

When the image on display surface 10A is wiped by erase roller 16, the wiping action applies shear forces to the dye of the image which separates the dye from the underlying release agent film. As the dye is separated, it either falls away from display board 10 or is retained on roller 16. Preferably, roller 16 is composed of an absorbent material (such as felt), and the wax in the dry erase ink is chosen to limit the amount of "dusting" that occurs upon erase so that the majority of the dye is retained by erase roller 16. It has been found that a single "wipe" of the image may not be sufficient to remove all of the dye therein. Accordingly, the electronic control means supplies appropriate driving signals to motor 78 at all times when carriage 12 is moving relative to display board 10 so that multiple "wipes" of the image on display surface 10A are provided. It will also be noted that the majority if not all of the "old image" is removed by erase roller 16 as carriage 12 moves from the right to the left in FIGS. 1 and 2, and that any remaining portion of the "old image" is removed by erase roller 16 as carriage 12 moves from the left to the right in FIGS. 1 and 2 and immediately preceding the printing of the "new image".

Each pad 56 is designed so as to contain a supply of ink sufficient to permit the printing of at least one image and, preferably, the printing of multiple images in succession. When the ink in at least one of the pads has been exhausted, either by imprinting or by evaporation of the solvent thereof, the electronic control means moves carriage 12 into proximity to re-inking station 18 which includes a plurality of vertically aligned and spaced dispensing valves 84, one for each print module 14. A supply of the dry erase ink is contained within a reservoir 86 mounted on an upper extension of angle frame 20 above dispensing valves 84 and conducted by gravity through a supply conduit 88 to each of the dispensing valves. With additional reference now to FIG. 6, each of the dispensing valves 84 is mounted on a plate 90 secured to an upper extended portion 20B of angle frame 20 and lower extended portion 20A of angle frame 20 and includes a housing 92 to which is coupled supply conduit 88. Housing 92 includes an aperture facing the associated print module, which aperture is normally closed by a ball 94 resiliently urged into the aperture by a spring 96 within housing 92. The aperture and ball in each dispensing valve 84 are vertically and horizontally aligned with the pad 56 of the associated print module when carriage 12 is at re-inking station 18. In response to electrical signals from the electronic control means, the solenoid 58 in each print module is energized when carriage 12 is at re-inking station 18, whereby the resultant rotation of arm 52 from its rest position causes pad 56 to engage ball 94 and move ball 94 out of the associated aperture in housing 92 so as to conduct the ink through housing 92 to pad 56. At a predetermined time thereafter sufficient to allow re-inking of the pad, all of the solenoids are deenergized by the electronic control means and the print modules are thereafter available for printing in the manner previously described.

Figure 7:
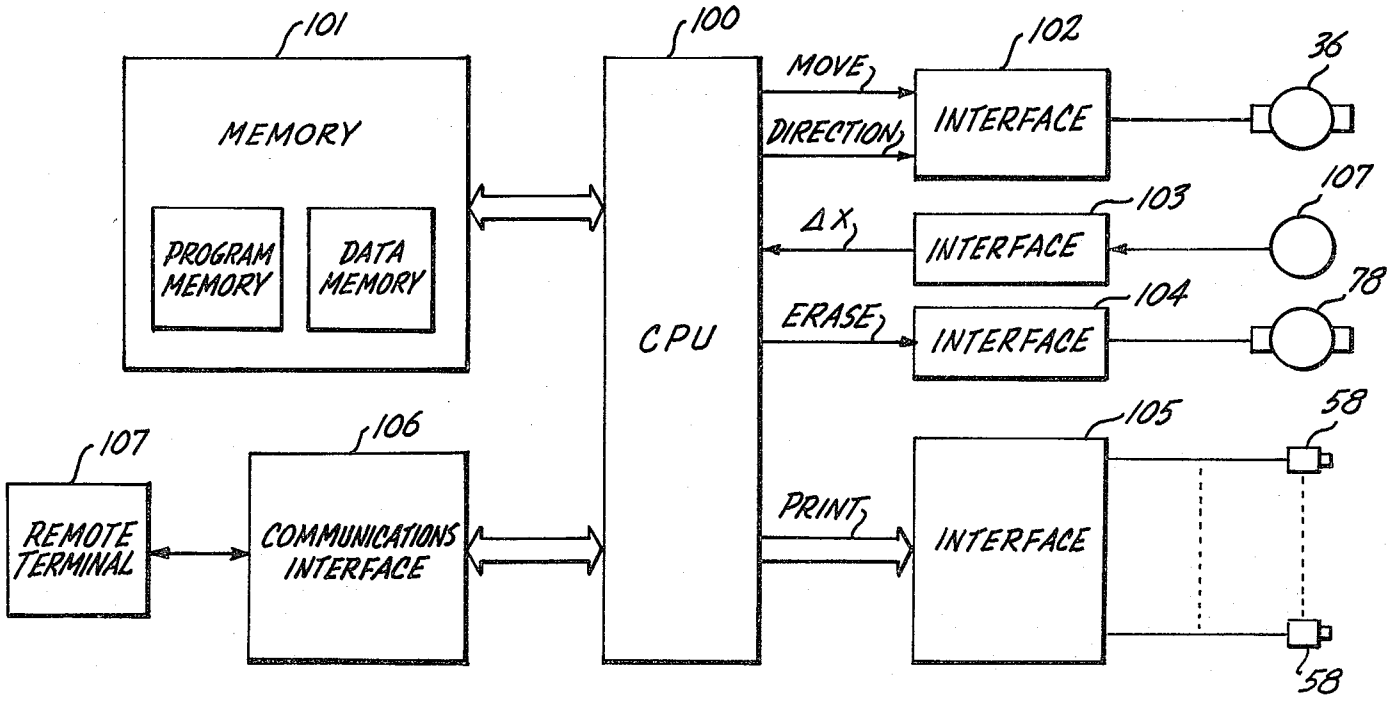
FIG. 7 is a block diagram of an electronic control means for the embodiment of FIGS. 1-6.

With reference now to FIG. 7, an electronic control means for use with the embodiment of the sign illustrated in FIGS. 1–6 includes a programmed data processor comprising a central processing unit (CPU) 100, a memory 101, a plurality of interface circuits 102, 103, 104, and 105, and a communications interface circuit 106.

Memory 101 includes a program memory that stores the operating program for the sign, and a data memory that stores a plurality of sets of information to be displayed. Preferably, each set of information within the data memory includes a digital representation of the information to be displayed and also includes command data which represents the time and duration for which the information therein is to be displayed. Memory 101 and the program memory and data memory therein may be implemented in various forms (such as a semiconductor memory, a bubble memory, or a cassette memory) to fit a particular application.

CPU 100 is operative under control of the operating program within the program memory and a real-time clock within CPU 100 to undertake the following actions. Each set of information to be displayed is retrieved by CPU 100 from the data memory at the appropriate time stored in that set. After retrieving the set of information, CPU 100 then supplies a DIRECTION signal and a MOVE signal in succession to interface circuit 102 which responsively provides driving signals to motor 36 so that carriage 12 is caused to move from the right to the left in FIG. 1. During movement of carriage 12, an encoder 107 on the shaft of motor 36 provides a series of pulses to interface circuit 103, with each pulse representing an increment of distance traveled by carriage 12, and interface circuit 103 responsively provides a $\Delta X$ signal to CPU 100 that changes with each pulse from encoder 107. Preferably, the increment of distance traveled that is represented by each pulse from encoder 107 is chosen so that CPU 100 is capable of very precisely determining the position of carriage 12 relative to display surface 10A by monitoring changes in the $\Delta X$ signal. As carriage 12 is being moved, CPU 100 also supplies an ERASE signal to interface circuit 104 which responsively provides driving signals to motor 78, whereby erase roller 16 is continuously rotated to remove previously-printed information on display surface 10A. When carriage 12 reaches either end of display surface 10A and the rollers 32 and 34 engage the adjacent stops 45, the pulses from encoder 107 terminate and CPU 100 determines that carriage 12 is at either end of display surface 10A by sensing a failure of the $\Delta X$ signal to change for a predetermined period of time. Whenever carriage 12 is sensed by CPU as being at either end of display surface 10A, CPU 100 responsively terminates the DIRECTION and MOVE signals supplied to interface circuit 102 so as to terminate rotation of motor 36 and therefore any further movement of carriage 12.

With carriage 12 resting at the far left in FIG. 1, CPU 100 then applies the DIRECTION and MOVE signals in succession to interface circuit 102 which responsively provides driving signals to motor 36, whereby carriage 12 is caused to move to the right in FIG. 1. As carriage 12 is thus moved, CPU 100 supplies the ERASE signal to interface circuit 104 which provides driving signals to motor 78, whereby roller 16 is again continuously rotated, and supplies PRINT signals to interface circuit 105 in accordance with the information in the set that has been retrieved from the program memory and at times determined by the relative position of carriage 12 established by the $\Delta X$ signal. In response to the PRINT signals, interface circuit 105 selectively provides appropriate electrical signals to the solenoids 58 in the plurality of print modules whereby the desired information is printed on display surface 10A.

At times (which may be periodic) when re-inking of the print modules is required, CPU 100 causes carriage 12 to be moved to the vicinity of re-inking station 18. When CPU 100 detects that carriage 12 is at re-inking station 18 (through the $\Delta X$ signal), CPU 100 supplies the PRINT signals to interface circuit 105 which responsively applies electrical signals to each of the solenoids 58 whereby re-inking is accomplished as previously described.

In order to permit the operations of the sign to be monitored and controlled from a remote location, communications interface circuit 106 is adapted to permit CPU 100 to exchange signals with a remote terminal 107 via a conventional data communications link. Remote terminal 107 may include a display that is capable of depicting the information being displayed by the sign at any point in time or the information within any of the sets of information in the data memory, and may also include means that permit any of these sets of information or the operating program within the program memory to be remotely modified through remote terminal 107.

Figure 9:
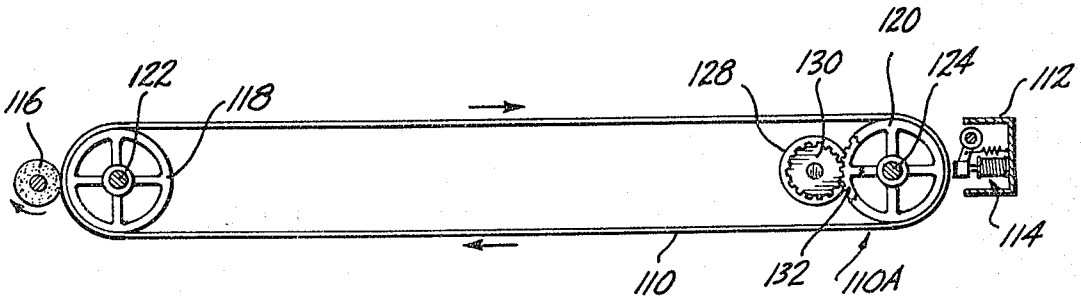
Figure 8:
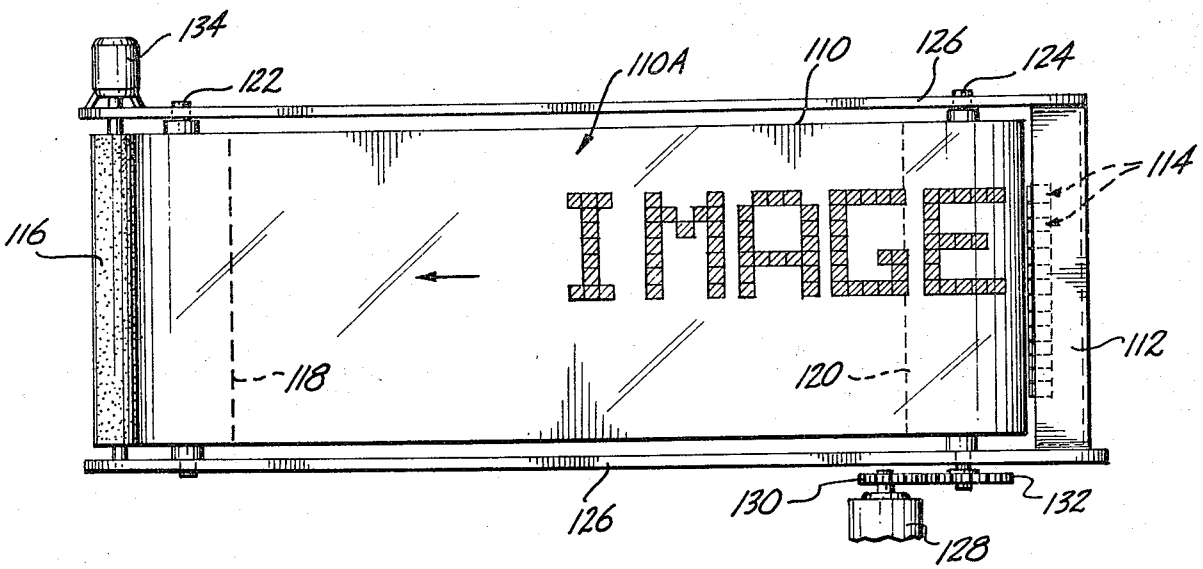
FIG. 8 is a front elevation view of a second embodiment of the variable information sign; and, FIG. 9 is a cross-sectional plan view corresponding to FIG. 7.

Another embodiment of the sign is seen in FIGS. 8 and 9 and includes a movable display member 110 having a display surface 110A, a fixed print station 112 including a plurality of print modules 114, and an erase roller 116. Display member 110 comprises an endless belt of a suitable flexible material having a smooth and nonporous surface (such as polypropylene) which passes around first and second drums 118, 120 mounted on respective shafts 122, 124 rotatably journaled in a frame 126. Drum 120 is rotated by a motor 128 through a gear 130 on the shaft of motor 128 and a gear 132 on shaft 124 of drum 120, so as to move display member 110 relative to print station 112 (which is located in proximity to drum 120) and relative to erase roller 116 (which is located in proximity to drum 118). The arrangement of the print modules 114 within print station 112 and the construction of each print module are substantially identical to the arrangement and construction of print modules 14 in carriage 12 previously described. As display member 110 passes print station 112, the print modules 114 are selectively actuated to print the information to be displayed on display surface 110A. After all of the information has been printed and display member 110 has been moved to a position where the printed information is displayed, display member 110 is stopped by deenergization of motor 128. When new information is to be displayed, motor 128 and a motor 134 coupled with erase roller 116 are energized, whereupon the "old image" on display surface 110A is erased by erase roller 116 as display member 110 is drawn around drum 118. Simultaneously with this erasing operation, electrical signals are provided to the print modules 114 so that a "new image" to be displayed is imprinted. Although not illustrated, provision is also made for re-inking each of the print modules.

It will be appreciated that the billboard-type sign of the present invention has significant advantages over similar signs previously known and used.

The energy consumed by the sign of the present invention is limited to that consumed by the momentarily-actuated solenoids of the print modules and that consumed by the drive and erase roller motors. The sign of the present invention is constructed from readily-available, standard mechanical and electromechanical components and is therefore relatively inexpensive to manufacture. The sign of the present invention also requires relatively little maintenance, with such maintenance being principally limited to replacement at substantial intervals of the print module pads and the erase roller and to periodic replenishment of the ink reservoir. The light reflectance of the dye in the dry erase ink and the light reflectance of the display surface can be chosen to provide maximum contrast under adverse ambient lighting conditions, and the resolution of the information displayed can be flexibly adjusted to meet the requirements of a particular application by appropriately choosing the size of the print module pads, the relative vertical spacing of the print modules, and the timing of the electrical signals applied to the solenoids of the print modules upon relative motion between the display surface and the print modules.

While the invention has been described with respect to several embodiments, it is to be clearly understood by those skilled in the art that the invention is not limited thereto. As an example, the print modules may be horizontally staggered to meet the requirements of a particular application rather than being vertically aligned as previously described. As another example, bidirectional printing and displaying may be afforded to the sign illustrted in FIGS. 1–6 by mounting an erase roller on either side of carriage 12 and by providing an actuating means for each erase roller so that only one of the erase rollers is in contact with the display surface for a given direction of movement of the carriage relative to the display surface. As yet another example, the dispensing valves in re-inking station 18 in FIGS. 1 and 2 may be replaced by a plurality of solenoid-operated metering valves mounted on carriage 12, with each metering valve being associated with one of the print modules and being adapted to supply ink from a reservoir on carriage 12 to the pad of its associated print module when re-inking is desired. As still another example, maintenance of the erase roller may be reduced by replacing the erase roller with a supply drum, a take-up drum, and a sheet of absorbent fabric or webbing that is unspooled from the supply drum and spooled onto the take-up drum. In such an arrangement, the material or webbing on the take-up drum is maintained in contact with the display surface and the wiping action necessary to remove an image thereon is provided by rapidly moving the take-up drum in a vertical direction. Therefore, the scope of the invention is to be interpreted only in conjunction with the appended claims.

The embodiments of the invention in which an exclusive property or privilege is claimed are defined as follows:

1. A variable information sign comprising:

a display member having a smooth and substantially nonporous display surface;

a plurality of print modules disposed in proximity to said display member and facing said display surface, each said print module including a pad of porous material containing a dry erase ink and being selectively-actuable to bring said pad into contact with said display surface so as to print an image in the form of a matrix of discrete areas of ink thereon;

erase means disposed in proximity to said display member and facing said display surface for wiping said display surface to remove any image thereon; and, means for producing relative motion between said display member and said plurality of print modules and between said display member and said erase means, said plurality of print modules and said erase means being arranged so that upon said relative motion, any previously-printed images are first removed from said display surface by said erase means and an image of information desired to be displayed is thereafter formed on said display surface as said plurality of print modules are selectively actuated.

2. A sign as recited in claim 1, wherein said display member is stationary and wherein said means for producing relative motion is operative to move said plurality of print modules and said erase means relative to said display member.

3. A sign as recited in claim 2, wherein said display surface is substantially planar.

4. A sign as recited in claim 2, wherein said display member comprises a porcelain-coated board.

5. A sign as recited in claim 2, wherein said means for providing relative motion includes a carriage supported for translative motion relative to said display, and wherein said plurality of said print modules are mounted on and movable with said carriage.

6. A sign as recited in claim 5, wherein said plurality of said print modules are spaced on said carriage in a direction transverse to said translative motion of said carriage.

7. A sign as recited in claim 6, wherein said plurality of print modules are substantially aligned on said carriage in a direction transverse to said translative motion of said carriage.

8. A sign as recited in claim 7, wherein said carriage includes a shaft extending transversely to said translative motion of said carriage, and wherein each said print module further includes:

an arm rotatably supported on said shaft and having mounted thereon said pad;

means for biasing said arm to a rest position wherein said pad is out of contact with said display surface; and, means responsive to actuation of said print module for rotating said arm away from said rest position to bring said pad into contact with said display surface.

9. A sign as recited in claim 8, wherein said means responsive to actuation of said print module comprises an electrical solenoid.

10. A sign as recited in claim 8 further comprising re-inking means for supplying said dry erase ink to each of said plurality of print modules.

11. A sign as recited in claim 10, wherein said re-inking means includes:

a plurality of dispensing valves mounted adjacent said display member and substantially aligned in a direction transverse to said translative motion of said carriage; and, means for supplying said dry erase ink to each of said plurality of dispensing valves;

wherein each said dispensing valve is associated with one of said plurality of said print modules and includes a depressible actuator that is arranged to be engaged by the pad in its associated print module as its associated print module is actuated, each said dispensing valve being constructed so as to conduct said dry erase ink to said pad upon engagement of said pad with said depressible actuator; and, wherein said means for producing relative motion is operative to move said carriage into proximity to said plurality of dispensing valves so as to permit re-inking of each said print module upon actuation thereof.

12. A sign as recited in claim 5, wherein said erase means is mounted on and movable with said carriage, said erase means and said plurality of said print modules being arranged on said carriage so that said erase means wipes said display surface in advance of any contact between said display surface and said pads in said plurality of print modules as said carriage is moved relative to said display member.

13. A sign as recited in claim 12, wherein said erase means includes a roller of absorbent material supported by said carriage for rotation about an axis that is transverse to said translative motion of said carriage.

14. A sign as recited in claim 13, wherein said erase means further includes means supported by said carriage for continuously rotating said roller as said carriage is moved relative to said display member.

15. A sign as recited in claim 1, further comprising re-inking means for supplying said dry erase ink to each of said plurality of print modules.

16. A sign as recited in claim 1, wherein each said print module further includes:

an arm supported for rotation, said pad being mounted on said arm;

means biasing said arm to a rest position wherein said pad is out of contact with said display surface; and, means responsive to actuation of said print module for rotating said arm away from said rest position to bring said pad into contact with said display surface.

17. A sign as recited in claim 16, wherein said means responsive to actuation of said print module includes an electrical solenoid.

18. A sign as recited in claim 1, wherein said plurality of print modules and said erase means are stationary and wherein said means for producing relative motion is operative to move said display member relative to said plurality of print modules and said erase means.

19. A sign as recited in claim 18, wherein said display member includes: first and second spaced-apart drums supported for rotation about substantially parallel axes; and, an endless belt of flexible material having said display surface thereon and passing around said first and said second drums;

wherein said means for producing relative motion includes means for rotating one of said first and second drums;

wherein said plurality of print modules are disposed in proximity to one of said first and second drums and facing the portion of said display surface passing therearound; and, wherein said erase means is disposed in proximity to the other of said first and second drums and facing the portion of said display surface passing therearound.

20. A sign as recited in claim 19, wherein said flexible material is polypropylene.

21. A sign as recited in claim 19, wherein said plurality of print modules are spaced in a direction parallel to said axes of rotation of said first and second drums.

22. A sign as recited in claim 21, wherein said pluraliy of said print modules are substantially aligned in a direction parallel to said axes of rotation of said first and second drums.

23. A sign as recited in claim 22, wherein each said print module further includes:

an arm supported for rotation about an axis parallel to said axes of rotation of said first and second drums, said arm having mounted thereon said pad;

means for biasing said arm to a rest position wherein said pad is out of contact with said display surface; and, means responsive to actuation of said print module for rotating said arm away from said rest position to bring said pad into contact with said display surface.

24. A sign as recited in claim 23, wherein said means responsive to actuation of said print module includes an electrical solenoid.

25. A sign as recited in claim 19, wherein said erase means includes a roller of absorbent material supported for rotation about an axis parallel to said axes of rotation of said first and second drums.

26. A sign as recited in claim 25, wherein said erase means further includes means for continuously rotating said roller as said flexible belt is moved relative to said plurality of said print modules and said erase means.

27. A sign as recited in claim 1, wherein said plurality of print modules are spaced in a direction transverse to said relative motion between said plurality of print modules and said display member.

28. A sign as recited in claim 1, wherein said erase means includes a roller of absorbent material supported for rotation about an axis transverse to said relative motion between said erase means and said display member.

* * * * *